US010451076B2

(12) United States Patent
Weng et al.

(10) Patent No.: US 10,451,076 B2
(45) Date of Patent: Oct. 22, 2019

(54) VENTILATING FAN

(71) Applicants: Panasonic Ecology Systems Guangdong Co., Ltd., Foshan, Guangdong (CN); Panasonic Corporation, Osaka (JP)

(72) Inventors: Yefan Weng, Guangdong (CN); Shouyong Gao, Guangdong (CN); Bodong Zhong, Guangdong (CN); Zhengnan Zeng, Guangdong (CN); Min Long, Guangdong (CN); Daisuke Tsubosa, Aichi (JP)

(73) Assignees: PANASONIC ECOLOGY SYSTEMS GUANGDONG CO., LTD. (CN); PANASONIC CORPORATION (JP)

( * ) Notice: Subject to any disclaimer, the term of this patent is extended or adjusted under 35 U.S.C. 154(b) by 536 days.

(21) Appl. No.: 14/482,066

(22) Filed: Sep. 10, 2014

(65) Prior Publication Data

US 2015/0086353 A1 Mar. 26, 2015

(30) Foreign Application Priority Data

Sep. 25, 2013 (CN) ..... 2013 2 0594101 U

(51) Int. Cl.
*F24F 7/02* (2006.01)
*F04D 19/00* (2006.01)
(Continued)

(52) U.S. Cl.
CPC ..... *F04D 19/002* (2013.01); *F04D 17/16* (2013.01); *F04D 25/068* (2013.01);
(Continued)

(58) Field of Classification Search
CPC ..... F24F 7/007; F24F 13/20; F24F 2013/205; F24F 2013/207; F24F 7/013; F24F 13/0209; F24F 11/0001; F24F 2221/32; F24F 7/00; F24F 7/02; H02G 3/123; H02G 3/086; H02G 3/121; H02G 3/08; H02G 3/081; H02B 1/044; H02B 1/40; F04D 19/002; F04D 17/16; F04D 25/068; F04D 25/0693; F04D 25/08; F04D 29/626;
(Continued)

(56) References Cited

U.S. PATENT DOCUMENTS 1,857,787 A * 5/1932 Meeks ..... H02G 3/086 220/3.4
2,286,898 A * 6/1942 Cover ..... H02G 3/123 220/3.6

(Continued)

*Primary Examiner* — Dominick L Plakkoottam
(74) *Attorney, Agent, or Firm* — RatnerPrestia

(57) ABSTRACT

A ventilating fan includes a frame, a casing in which a fan motor is mounted, an adapter connected to an air outlet of the casing, a switch, and a junction box for connection of electric wires, where the frame has a bottom surface formed with an air inlet and a side surface provided with an air outlet, wherein any one of surfaces of the junction box is formed with an opening for mounting of the switch and the switch is fixed directly to the opening of the junction box. With the ventilating fan according to the embodiments of the present invention, although a switch is disposed, the cost is not increased and the area of an air path is not narrowed, and the switch can also be conveniently operated.

7 Claims, 10 Drawing Sheets

(51) Int. Cl.

| | |
|---|---|
| ***F24F 13/20*** | (2006.01) |
| ***F04D 17/16*** | (2006.01) |
| ***F04D 25/06*** | (2006.01) |
| ***F04D 25/08*** | (2006.01) |
| *F24F 7/007* | (2006.01) |

(52) U.S. Cl.
CPC ..... *F04D 25/0693* (2013.01); *F04D 25/08* (2013.01); *F24F 7/007* (2013.01); *F24F 13/20* (2013.01)

(58) Field of Classification Search
CPC .. F04D 29/4226; F04D 29/522; F04D 29/646; F04D 29/703; Y10S 248/906; F21V 33/0088
USPC ..... 174/63; 413/214.1, 215.1; 220/3.6; 454/349; 362/96
See application file for complete search history.

(56) References Cited

U.S. PATENT DOCUMENTS 2,780,981 A * 2/1957 Miller ..... F24F 7/065 415/148
3,483,309 A * 12/1969 Garcia ..... H01R 13/5804 174/665
4,336,749 A * 6/1982 Barnhart ..... F24F 13/20 248/58
4,739,153 A * 4/1988 Rendel ..... F24H 3/0411 126/110 B
4,914,833 A * 4/1990 Pilolla ..... A47K 10/48 34/202
5,703,327 A * 12/1997 Jorgensen ..... H02G 3/086 174/53
6,121,897 A * 9/2000 Flegel ..... G08G 1/095 340/693.2
6,354,287 B1 * 3/2002 Kudoh ..... F04D 29/601 126/299 D
6,585,486 B2 * 7/2003 Birdsell ..... F04D 29/601 415/213.1
6,979,169 B2 * 12/2005 Penlesky ..... F04D 29/4226 415/1
7,455,500 B2 * 11/2008 Penlesky ..... F04D 29/4226 415/206
8,784,040 B2 * 7/2014 Masuda ..... F04D 25/12 415/121.3
8,876,582 B2 * 11/2014 Gao ..... F24F 7/007 454/341
2001/0049260 A1 * 12/2001 Larson ..... F24F 7/007 454/354
2003/0012641 A1 * 1/2003 Birdsell ..... F04D 29/601 415/118
2008/0318515 A1 * 12/2008 Yeung ..... F04D 29/4206 454/354
2012/0164936 A1 * 6/2012 Gao ..... F24F 7/007 454/341
2013/0130613 A1 * 5/2013 Long ..... F24F 13/14 454/369
2013/0153256 A1 * 6/2013 Laughlin ..... H02G 3/081 174/50
2015/0086353 A1 * 3/2015 Weng ..... F04D 17/16 415/213.1

* cited by examiner

VENTILATING FAN

CROSS-REFERENCE TO RELATED APPLICATION

This application claims the benefit of Chinese Patent Application No. 201320594101.7 filed on Sep. 25, 2013 in the State Intellectual Property Office of China, the whole disclosure of which is incorporated herein by reference.

BACKGROUND OF THE INVENTION

1. Field of the Invention

The present invention relates to a ventilating fan, and particularly to a ventilating fan mounted between a roof and a ceiling.

2. Description of the Related Art

A ventilating fan mounted between a roof and a ceiling is a common ventilation apparatus. A well-known ventilating fan generally comprises a frame, a casing in which a fan motor is mounted, an adapter connected to an air outlet of the casing, and a junction box for connection to electric wires. The frame has a bottom surface formed with an air inlet and a side surface provided with an air outlet. In order to achieve functions such as air flow rate adjustment, in some ventilating fans, a switch box where a switch is disposed is also provided.

In order to mount a switch, the above-mentioned conventional ventilating fan needs to be additionally provided with a switch box where the switch is disposed, and it is necessary to use a lead wire for connection between the switch box and the junction box and it is also necessary to subject the lead wire to processings such as fireproof processing and insulating processing. As a result, not only a cost is increased, but also an area of an air path within the ventilating fan frame is narrowed by provisions of both the switch box itself and the lead wire.

SUMMARY OF THE INVENTION

It is an object of the present invention to provide a ventilating fan in which the area of an air path is not narrowed although a switch is disposed therein.

In order to achieve the above object, there is provided a ventilating fan comprising a frame, a casing in which a fan motor is mounted, an adapter connected to an air outlet of the casing, a switch, and a junction box for connection to electric wires, wherein the frame has a bottom surface formed with an air inlet and a side surface provided with an air outlet, wherein any one of surfaces of the junction box is formed with an opening for mounting of the switch and the switch is fixed directly to the opening of the junction box.

The junction box is disposed inside the frame, and the switch is disposed to a bottom surface of the junction box.

A protruded sheet is extended from an upper edge of a side surface of the junction box towards an outside of the junction box, and an opening in which the protruded sheet is inserted is formed in an upper edge of the frame.

The junction box is disposed near a tongue portion of the casing.

Any one of side surfaces of the frame is formed with an insertion opening for the junction box, and the junction box is passed through the insertion opening from an inside of the frame and is fixed outside the frame.

The switch is disposed on an inner side surface of the junction box facing the inside of the frame.

A first extension part higher than a top surface of the junction box is extended from an upper edge of an inner side surface of the junction box, and a second extension part lower than a bottom surface of the junction box is extended from a lower edge of the inner side surface of the junction box.

A third extension part and a fourth extension part are extended beyond both sides of the junction box from left and right side edges of the inner side surface of the junction box, respectively.

A portion of the first extension part of the inner side surface of the junction box is bent towards the junction box side to form a bent sheet.

The second extension part of the inner side surface of the junction box is formed with a through hole.

A projected sheet perpendicular to the second extension part is projected from the second extension part towards the junction box side, and a recess is disposed on a lower edge of the projected sheet near the second extension part side.

With the ventilating fan according to the embodiment of the present invention, although a switch is disposed, the cost is not increased and the area of an air path is not narrowed, and the switch can also be conveniently operated.

DETAILED DESCRIPTION OF THE EMBODIMENTS

Figure 1A:
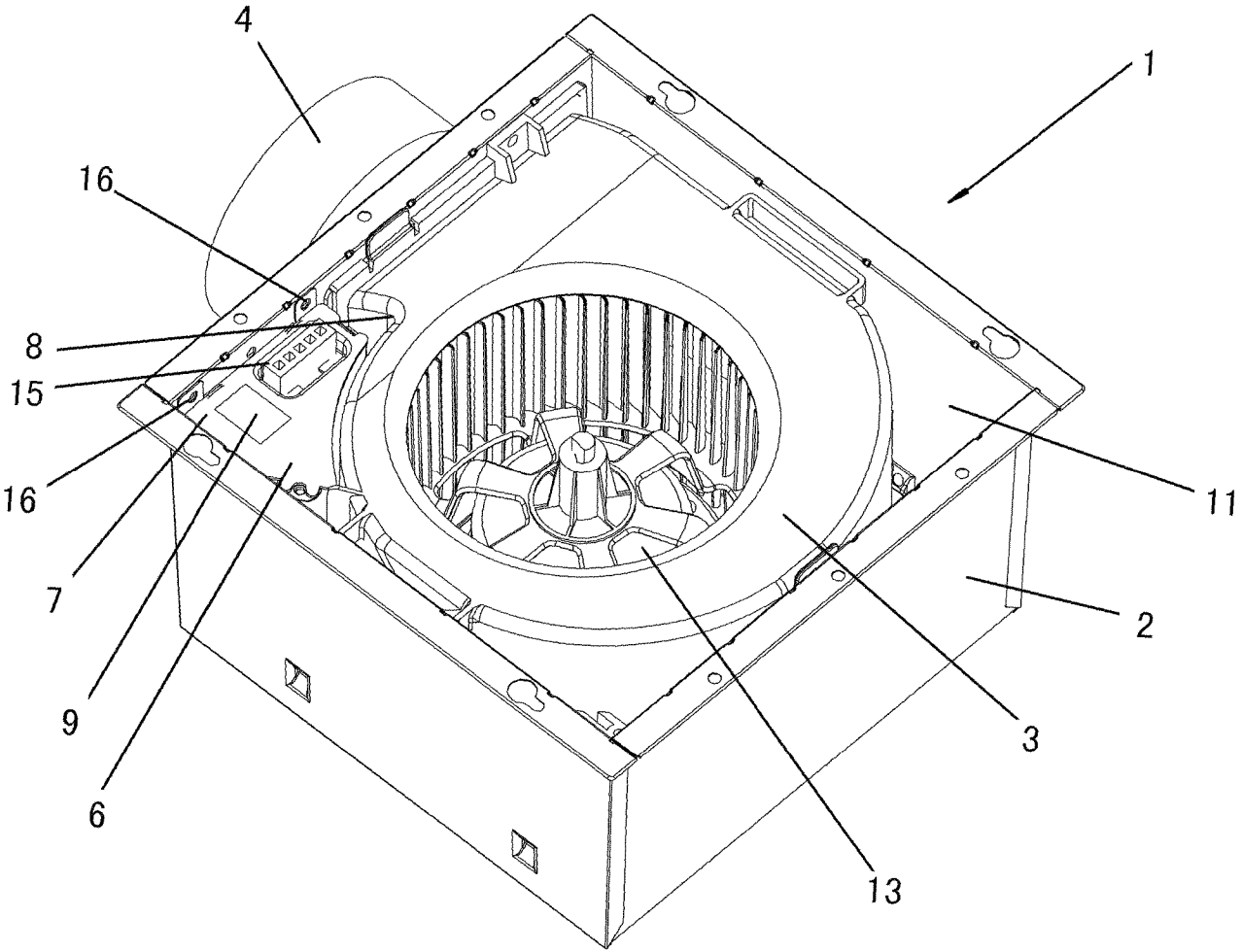
FIG. 1A is a general schematic view of a ventilating fan according to a first embodiment of the present invention.
Figure 1B:
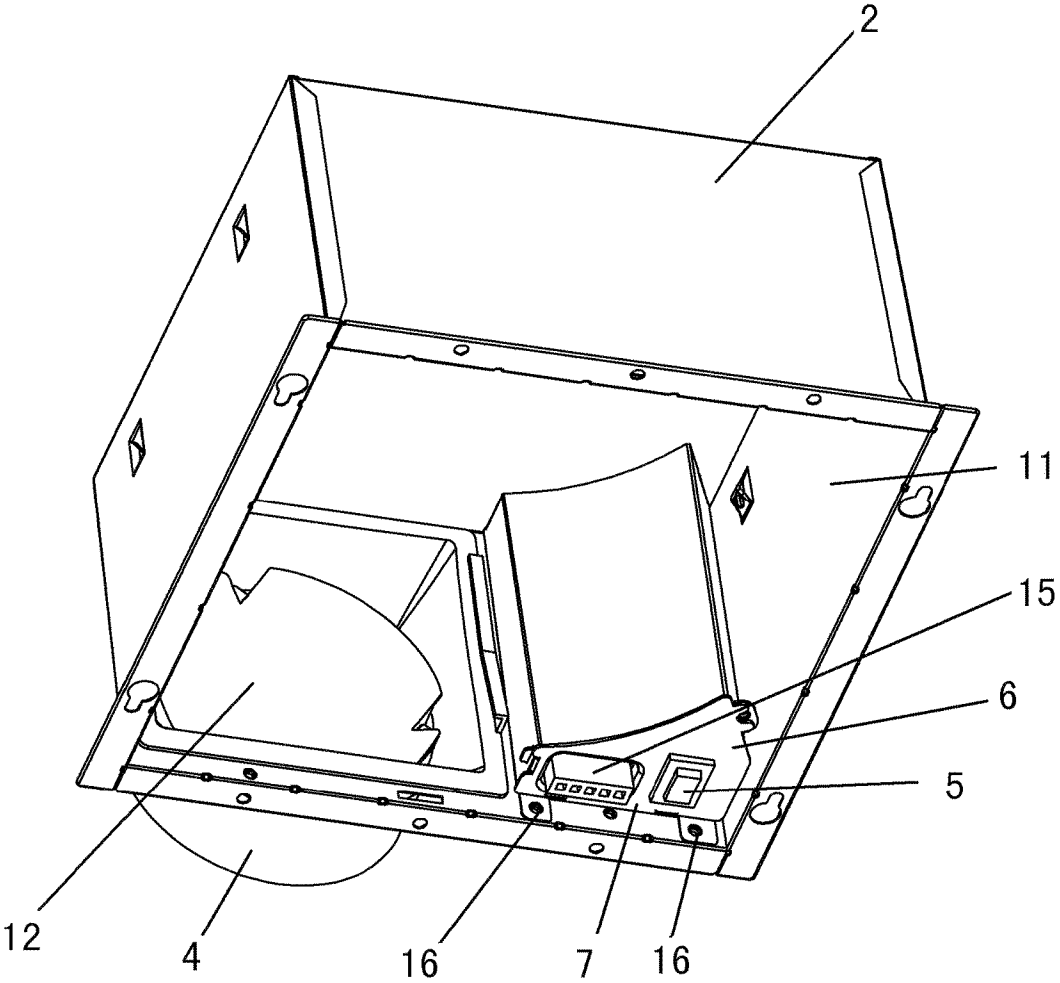
FIG. 1B is a partial schematic view of the ventilating fan according to the first embodiment of the present invention.
Figure 1C:
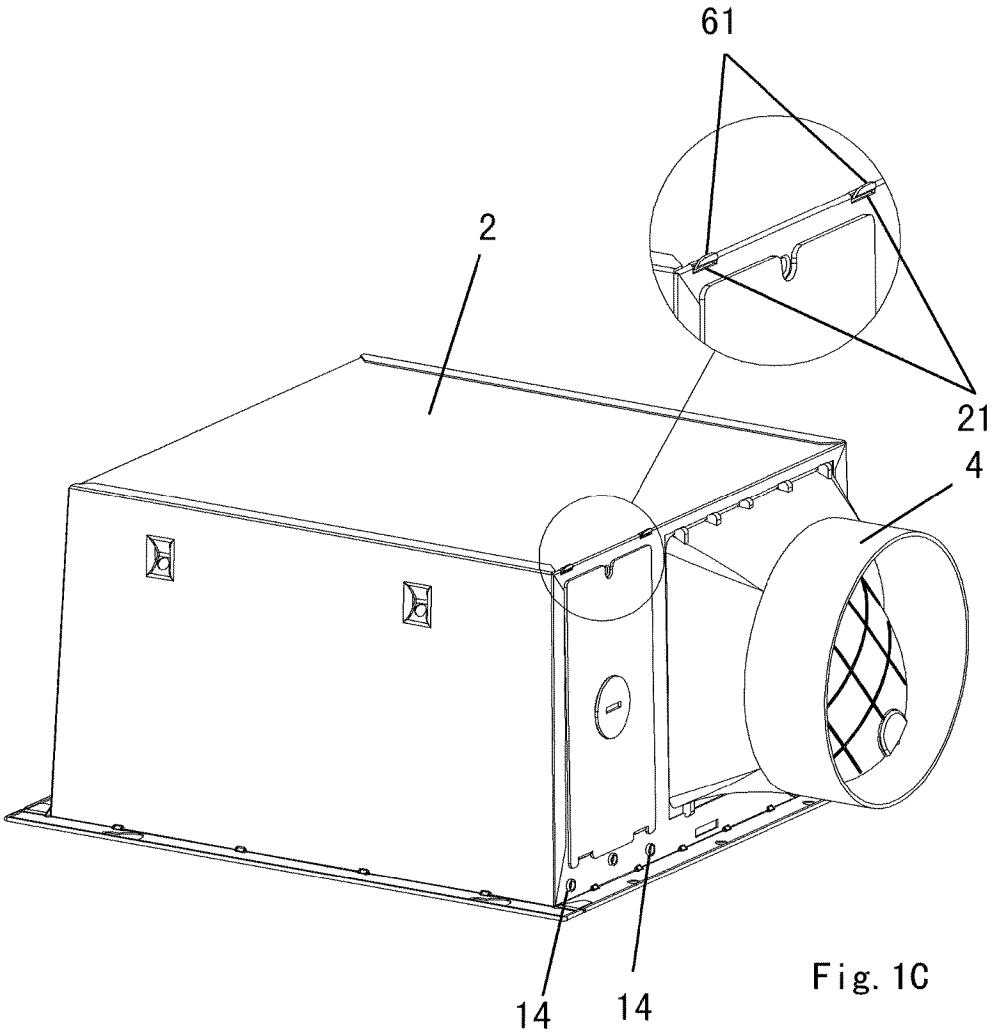
FIG. 1C is a partially enlarged schematic view of the ventilating fan according to the first embodiment of the present invention.

FIG. 1A is a schematic view of a ventilating fan according to a first embodiment of the present invention; FIG. 1B is a partial schematic view of the ventilating fan according to the first embodiment of the present invention; and FIG. 1C is a partially enlarged schematic view of the ventilating fan according to the first embodiment of the present invention.

As shown in the figures, the ventilating fan 1 comprises a cuboid frame 2, a casing 3 in which a motor 13 is mounted, an adapter 4 connected to an air outlet of the casing 3, and a junction box 6 provided with a switch 5 and configured for connection to electric wires. The frame 2 has a bottom surface formed with an air inlet 11 and a side surface provided with an air outlet 12. The junction box 6 is disposed near a tongue portion 8 of the casing 3 in such a way that it conforms to the shape of the casing 3. The switch 5 is fixed directly to an opening 9 of a bottom surface 7 of the junction box 6.

A space between the tongue portion 8 of the casing 3 and the frame 2 has a greater width than the rest of these spaces inside the frame 2. Accordingly, the junction box 6 is disposed near the tongue portion 8 of the casing 3. It can ensure that a mounting space of a greatest area (volume) in the junction box 6 can be obtained.

The bottom surface 7 of the junction box 6 is defined as a surface that is located at a bottom of the junction box 6 facing a user after the ventilating fan 1 is mounted between a ceiling and a roof.

The junction box 6 is disposed into the frame 2 from a bottom of the frame 2 and the switch 5 is disposed on the surface facing a user. Accordingly, when a user adjusts an air flow rate of the ventilating fan 1, he can open a louver (not shown) and conveniently adjust the switch 5, thereby adjusting the air flow rate, or the like.

The switch 5 comprises switches of types such as a speed adjusting switch and a light adjusting switch. The switch 5 is fixed to the opening 9 of the bottom surface 7 of the junction box 6, and is connected to the motor 13 by connecting to a terminal 15, located on the junction box 6, inside the junction box 6, thereby achieving functions such as the air flow rate adjustment.

In other words, the terminal 15 is disposed to the junction box 6, and it is not necessary to use a lead wire for connection between the switch 5 and the junction box 6. The switch 5 and the terminal 15 are connected through a lead wire, and the motor 13 and the terminal 15 are also connected through a lead wire, so that the switch 5 and the motor 13 are connected through the terminal 15. Furthermore, the switch 5 is fixed directly to the junction box 6. It is unnecessary to additionally dispose a switch box, and it is also unnecessary to use a lead wire for connection between the switch box and the junction box 6, as a result, the cost of the switch box and the lead wire is saved, and the area of an air path inside the frame 2 will not be narrowed due to existence of the switch box and the lead wire. In other words, even if the switch 5 is mounted inside the frame 2, reduction of the air flow rate can be prevented.

Since, regardless of which surface of the junction box 6 the switch 5 is mounted to, the switch 5 can be connected to the terminal 15 through the lead wire inside the junction box 6, the surface where the opening 9 for mounting of the switch 5 is formed may be any one of the surfaces of the junction box 6.

Further, as shown in FIGS. 1B and 1C, two protruded sheets 61 are extended from an upper edge of a side surface of the junction box 6 towards outside of the junction box 6, and two openings 21 in which the protruded sheets 61 are inserted are disposed in an upper end of the frame 2.

When the ventilating fan 1 is mounted to a joist, the frame 2 may be first mounted to the joist, and then the junction box 6 is inserted upwards into the frame 2 from a bottom side of the frame 2 in such a way that it avoids the tongue portion 8 of the casing 3 (referring to FIG. 1A), and the protruded sheets 61 at the upper edge of the side surface of the junction box 6 are inserted into and locked in the openings 21 formed in the upper edge of the side surface of the frame 2, so that the junction box 6 is temporarily locked to the frame 2. If the protruded sheet 61 is wide enough, only one single protruded sheet 61 is required. If the protruded sheet 61 is narrow, two or more protruded sheets 61 may be required. In addition, the junction box 6 is securely mounted to an inside of the frame 2 by passing a screw through a through hole 14 in the frame 2 and a through hole 16 in the junction box 6. In this way, it is not necessary to use a screw to fix the upper end of the junction box 6 so that the junction box 6 can be conveniently mounted, amounts of the screw can be reduced and the man hour can be saved.

Figure 2:
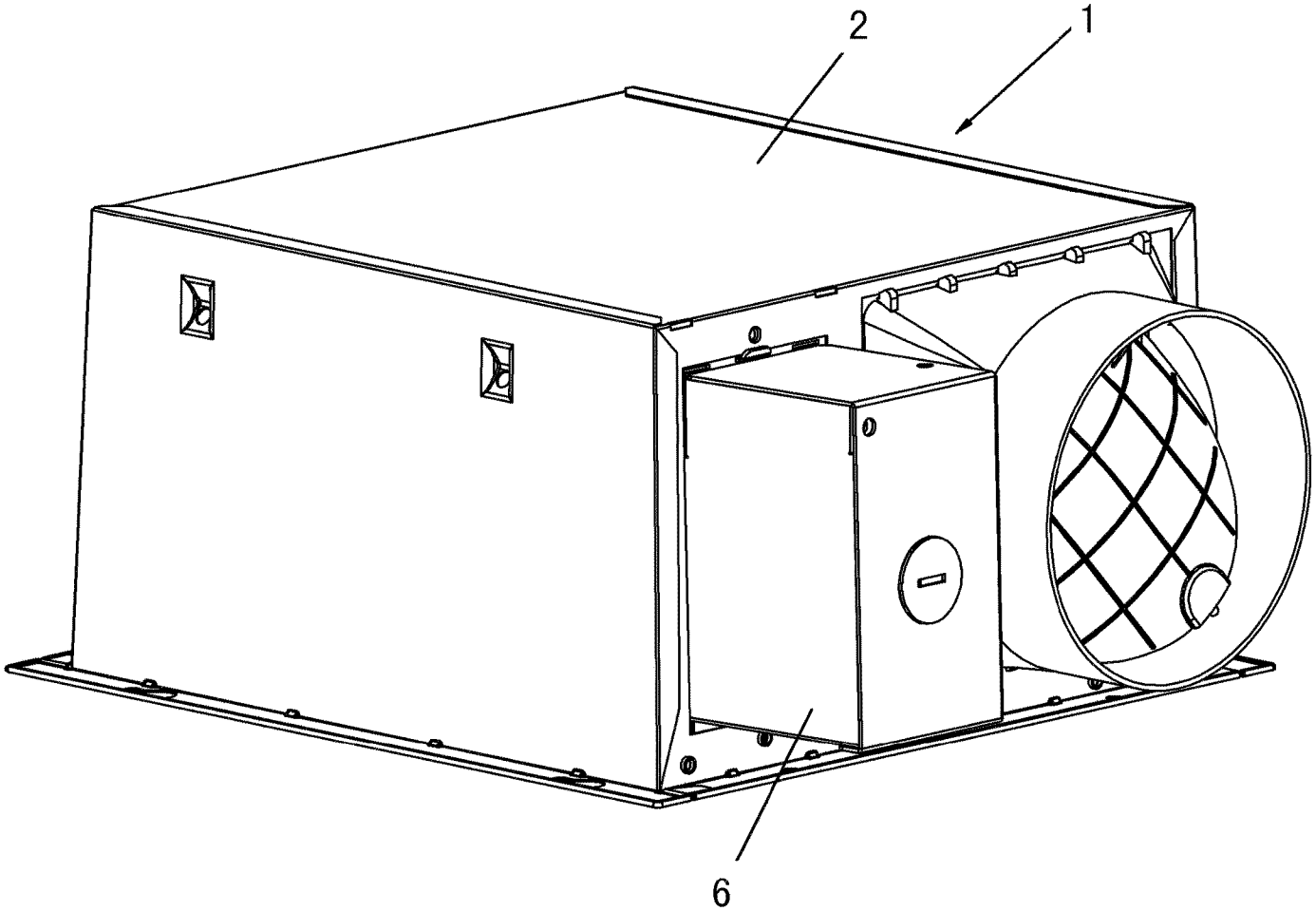
FIG. 2 is a general schematic view of a ventilating fan according to a second embodiment of the present invention.
Figure 3:
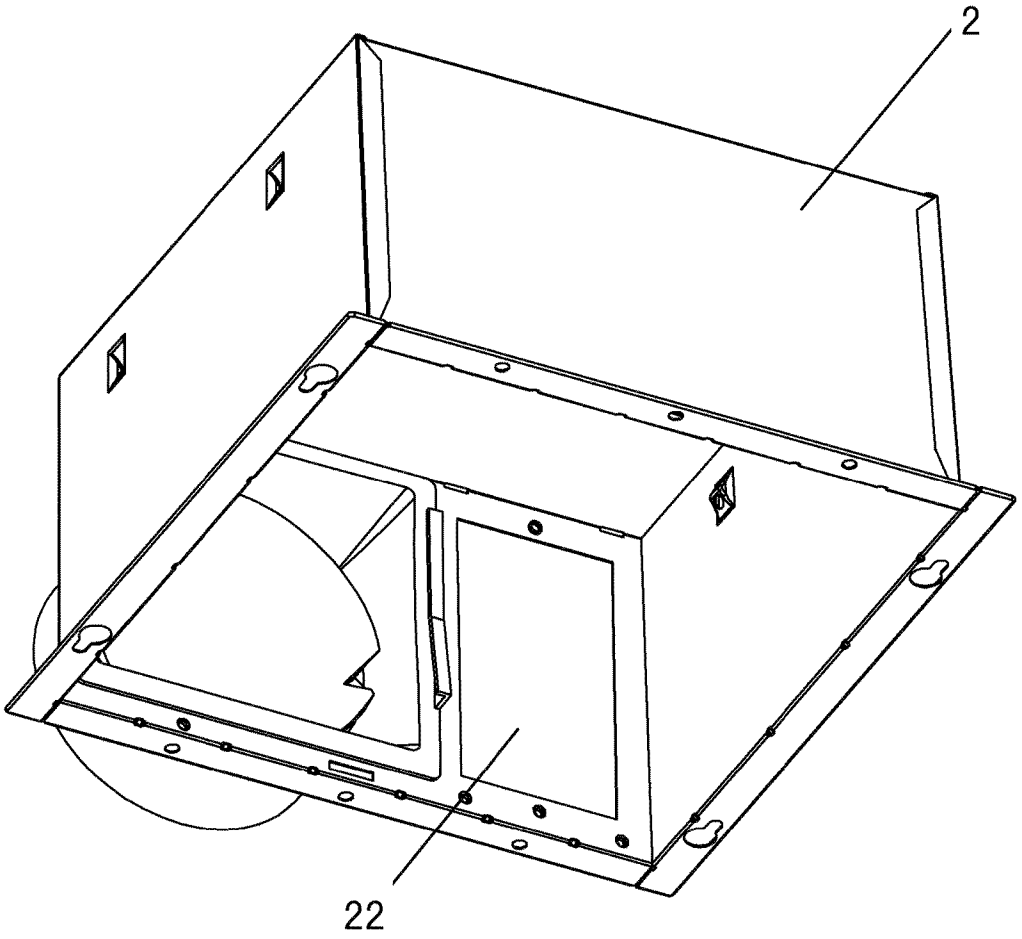
FIG. 3 is a schematic view of the ventilating fan in which a junction box is not mounted yet, according to the second embodiment of the present invention.
Figure 4:
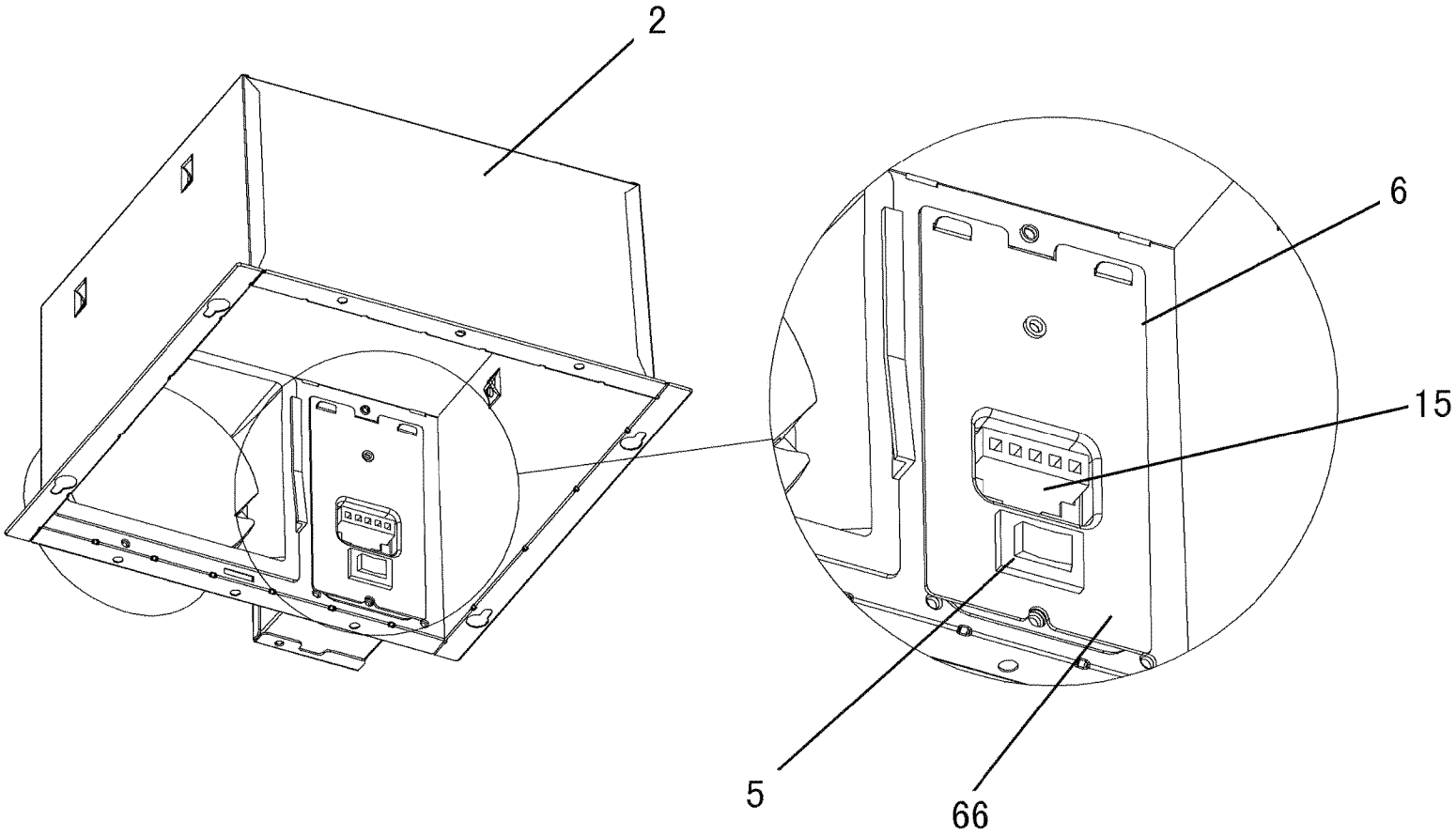
FIG. 4 is a schematic view of the ventilating fan in which the junction box is mounted, according to the second embodiment of the present invention.

FIG. 2 is a general schematic view of a ventilating fan according to a second embodiment of the present invention; FIG. 3 is a schematic view of the ventilating fan in which a junction box is not mounted yet, according to the second embodiment of the present invention; and FIG. 4 is a schematic view of the ventilating fan in which the junction box is mounted, according to the second embodiment of the present invention. As shown in the figures, a side surface of the frame 2 is formed with an insertion opening 22 for the junction box 6, and the junction box 6 is inserted upwards into the frame 2 from a bottom of the frame 2. After that, the junction box 6 is passed through the insertion opening 22 and is fixed at the outside of the frame 2. In this way, a larger area of an air path inside the frame 2 can be ensured.

In this embodiment, the side surface of the frame located on the same side as the adapter is selected to mount the junction box thereon. However, any other side surface of the frame may be selected to mount the junction box thereon according to actual situations.

The switch 5 is disposed on an inner side surface 66 of the junction box 6 facing the inside of the frame 2, and is connected to the motor (not shown) by connecting a terminal 15, located on the junction box 6, inside the junction box 6, thereby achieving functions such as the air flow rate adjustment. The inner side surface 66 of the junction box 6 is defined as a side surface of the junction box 6 facing the inside of the frame 2. The switch 5 is disposed on the inner side surface 66 of the junction box 6 facing the inside of the frame 2, near the bottom surface 64 side. When a user adjusts an air flow rate of the ventilating fan 1, he can open a louver and stretch out his hand into a gap between the casing (not shown) and the frame 2 to operate the switch 5.

Figure 5A:
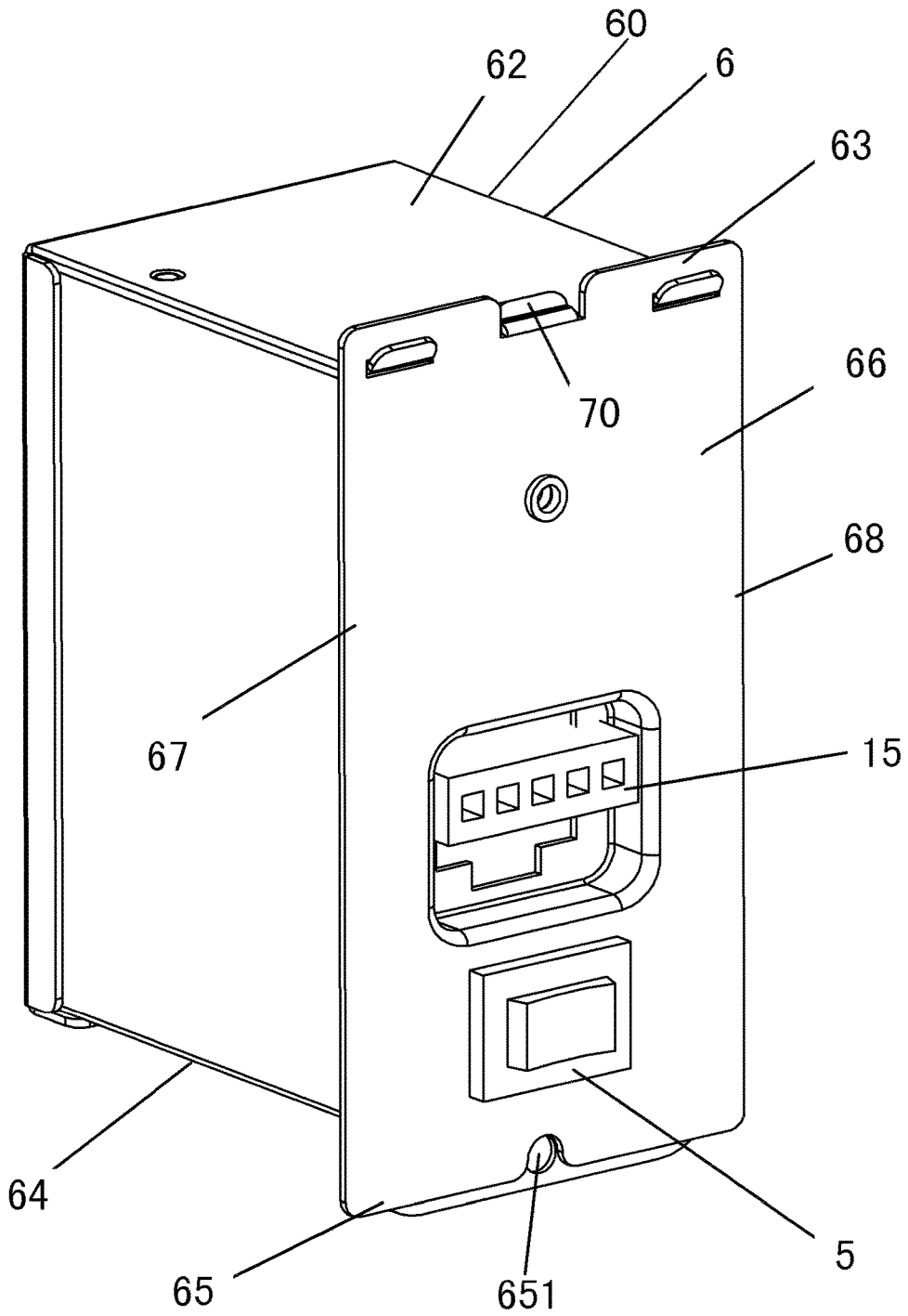
FIG. 5A is one schematic view of the junction box according to the second embodiment of the present invention.
Figure 5B:
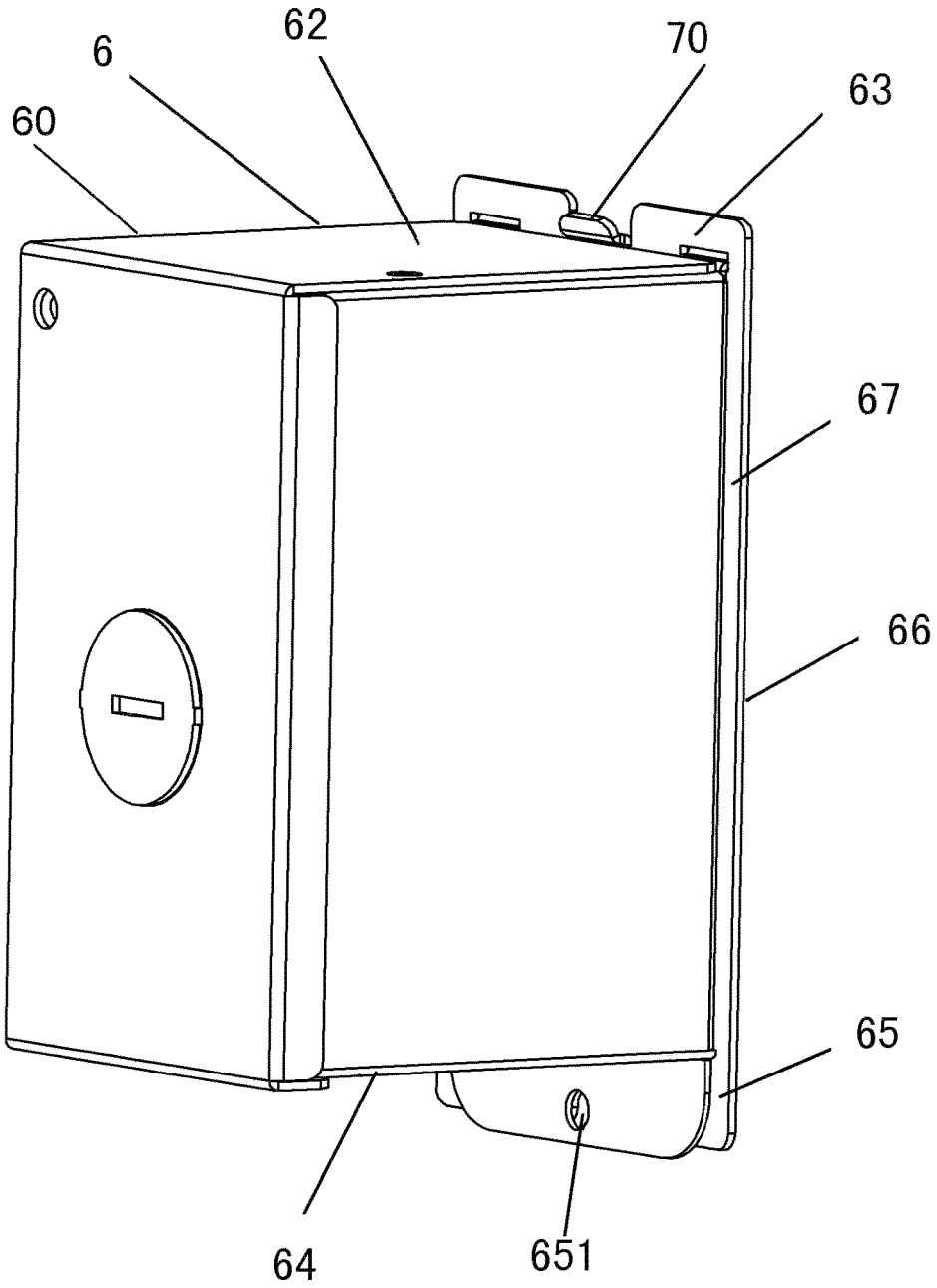
FIG. 5B is another schematic view of the junction box according to the second embodiment of the present invention.
Figure 6:
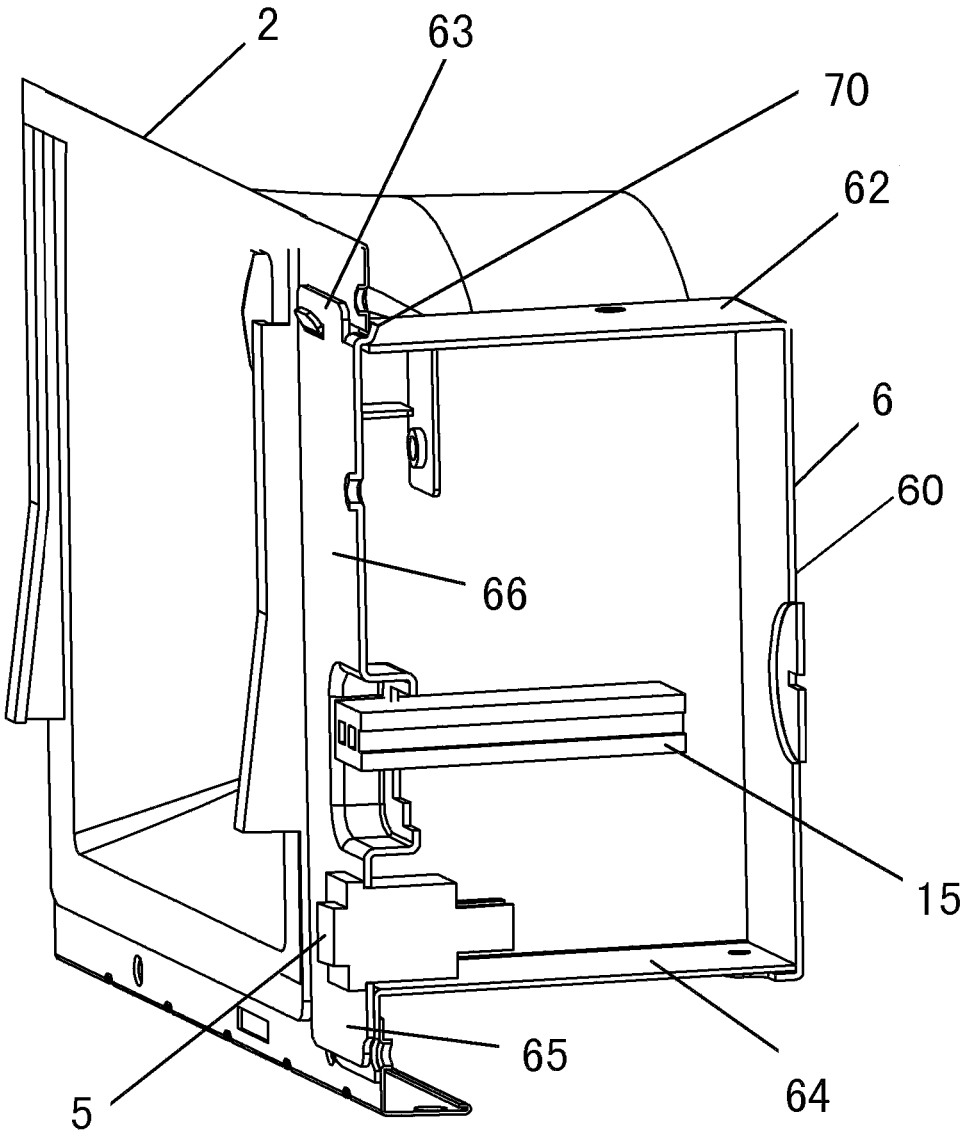
FIG. 6 is a schematic sectional view of the junction box according to the second embodiment of the present invention.
Figure 7:
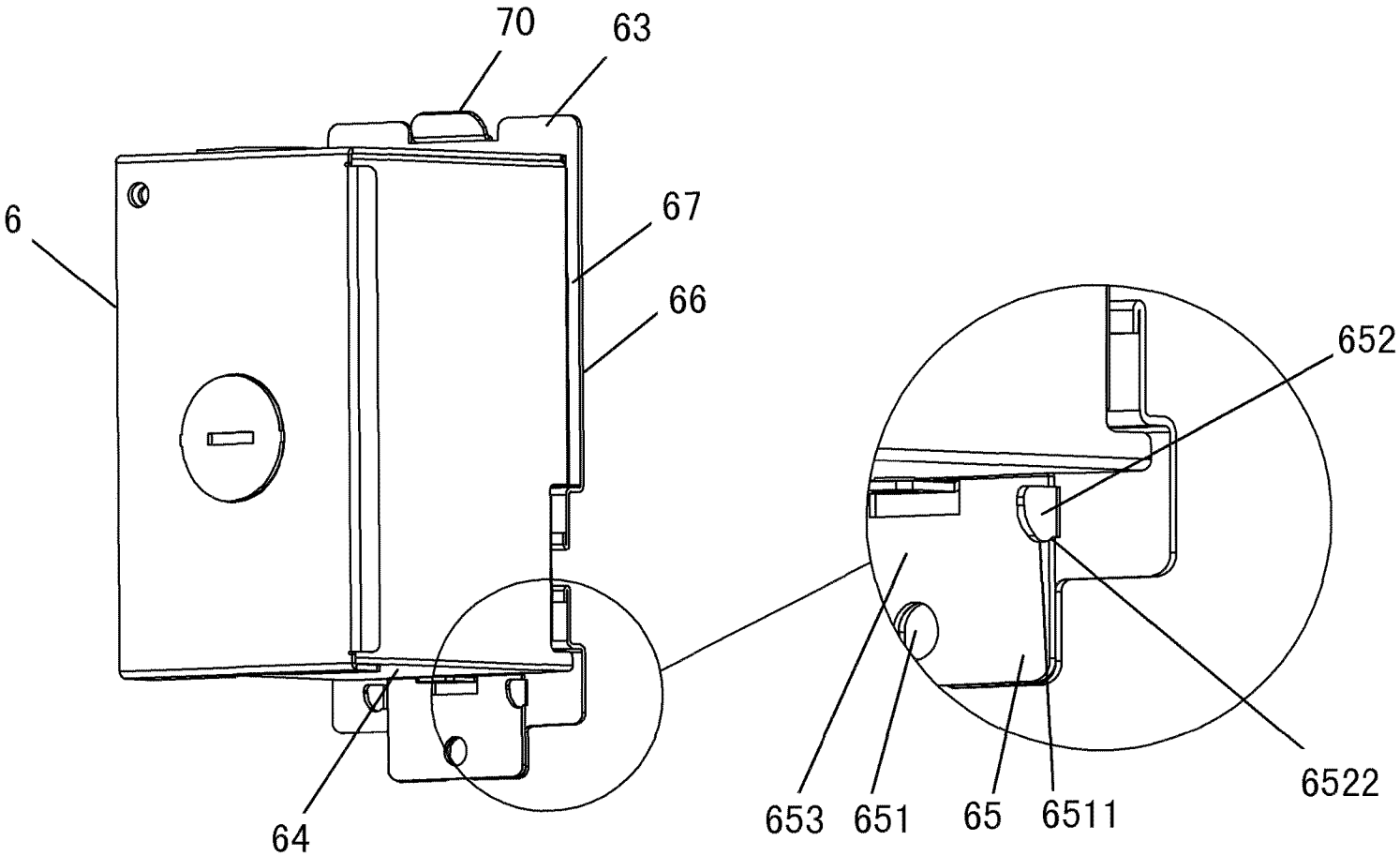
FIG. 7 is a schematic view of a junction box according to a third embodiment of the present invention.

FIG. 5A is one schematic view of the junction box according to the second embodiment of the present invention; FIG. 5B is another schematic view of the junction box according to the second embodiment of the present invention; FIG. 6 is a schematic sectional view showing a bent sheet for mounting of the junction box according to the second embodiment of the present invention; and FIG. 7 is a schematic view of a junction box according to a third embodiment of the present invention.

As shown in the figures, the junction box 6 comprises a main body 60, a first extension part 63 higher than a top surface 62 of the junction box 6 is extended from an upper edge of the inner side surface 66 of the junction box 6, and a second extension part 65 lower than the bottom surface 64 of the junction box 6 is extended from a lower edge of the inner side surface 66 of the junction box 6. A third extension part 67 and a fourth extension part 68 are extended beyond both sides of the junction box 6 from left and right side edges of the inner side surface 66 of the junction box 6, respectively. A portion of the first extension part 63 of the inner side surface 66 of the junction box 6 is bent towards the junction box 6 side to form a bent sheet 70. The second extension part 65 of the inner side surface 66 of the junction box 6 is formed with a through hole 651.

When the ventilating fan 1 is mounted to a joist, the frame 2 may be first mounted to the joist, and then the junction box 6 is passed through the insertion opening 22 of the side surface of the frame 2 from an inside of the frame 2. The first extension part 63 higher than the top surface 62 of the junction box 6 is extended from the upper edge of the inner side surface 66 of the junction box 6, the second extension part 65 lower than the bottom surface 64 of the junction box 6 is extended from the lower edge of the inner side surface 66 of the junction box 6, and the third extension part 67 and the fourth extension part 68 are extended beyond both sides of the junction box 6 from the left and right side edges of the inner side surface 66 of the junction box 6, respectively. Accordingly, the first extension part 63, the second extension part 65, the third extension part 67 and the fourth extension part 68 will come into contact with a portion, surrounding the insertion opening 22, of the side surface of the frame 2 so that they cannot be passed through the insertion opening 22.

Since the bent sheet 70 is bent towards the junction box 6 side, the junction box 6 can be obliquely inserted into the insertion opening 22 (i.e., the first extension part 63 is first inserted into the insertion opening 22 and the second extension part 65 is then inserted into the insertion opening 22). After the bent sheet 70 is also passed through the insertion opening 22, the frame 2 can be grasped by the inner side surface 66 of the junction box 6 and the bent sheet 70 so that the junction box 6 is temporarily fixed to the frame 2. If the bent sheet 70 is wide enough, it is only necessary to dispose a single bent sheet 70 at a middle portion of the first extension part 63. If the bent sheet 70 is narrow, two or more bent sheets may be disposed. It is only necessary to dispose a single through hole at a middle portion of the second extension part 65.

Alternatively, as shown in FIG. 7, a projected sheet 652 perpendicular to the second extension part 65 is projected from the second extension part 65 towards the junction box 6 side, and a recess 6522 is disposed on a lower end 6511 of the projected sheet 652 near the second extension part 65 side. If the projected sheet 652 is thick enough, it is only necessary to dispose a single projected sheet 652 at a middle portion of the second extension part 65 in a horizontal direction. If the projected sheet 652 is thin, two projected sheets 652 may be disposed on both sides of the second extension part 65. Of course, two or more projected sheets 652 may also be disposed side by side on the second extension part 65. In this way, after the junction box 6 is inserted into the insertion opening 22 and the bent sheet 70 is also passed through the insertion opening 22, the projected sheet 652 may be placed on the insertion opening 22, and the recess 6522 is locked to the frame 2 so that the junction box 6 can be temporarily fixed firmly to the frame 2. Then, a screw is passed outwards through the through hole in the frame 2 and the through hole in the second extension part 65 of the junction box 6 from the inside of the frame 2 so that the junction box 6 is firmly mounted outside the frame 2. In this way, the frame 2 is grasped by the bent sheet 70 on the first extension part 63 at the upper end of the junction box 6 and the inner side surface 66 of the junction box 6, and the second extension part 65 at the lower end is fixed outwards to the frame 2 from the inside of the frame 2 by a screw. In other words, it is just necessary to use one screw to complete the fixation and mounting of the junction box 6. Therefore, the mounting is very convenient.

After the junction box 6 is mounted, the first extension part 63, the second extension part 65, the third extension part 67 and the fourth extension part 68 are brought to be abutted against the frame 2, to ensure air tightness between the junction box 6 and the frame 2.

What is claimed is:

1. A ventilating fan comprising: a frame, a casing in which a fan motor is mounted, a switch, and a junction box for connection of electric wires, wherein the frame has a bottom surface formed with an air inlet and a side surface provided with an air outlet, wherein any one of the surfaces of the junction box is formed with an opening for mounting of the switch, and the switch is fixed directly to the opening of the junction box, wherein any one of the side surfaces of the frame is formed with an insertion opening for the junction box, and the junction box is passed through the insertion opening from inside the frame and is fixed outside of the frame, wherein the switch is disposed on an inner side surface of the junction box facing the inside of the frame, wherein a first extension part, higher than a top surface of the junction box, extends from an upper edge of an inner side surface of the junction box, and a second extension part, lower than a bottom surface of the junction box, extends from a lower edge of the inner side surface of the junction box, and wherein a projected sheet perpendicular to the second extension part projects from the second extension part towards the junction box side, and a recess is disposed in a lower edge of the projected sheet near the second extension part.

2. The ventilating fan of claim 1, wherein: a third extension part and a fourth extension part extend beyond both sides of the junction box from left and right side edges of the inner side surface of the junction box, respectively.

3. The ventilating fan of claim 1, wherein: a portion of the first extension part of the inner side surface of the junction box is bent towards the junction box side to form a bent sheet.

4. The ventilating fan of claim 1, wherein: the second extension part of the inner side surface of the junction box is formed with a through hole.

5. A ventilating fan comprising: a frame, a casing in which a fan motor is mounted, a switch, and a junction box for connection of electric wires, wherein the frame has a bottom surface formed with an air inlet and a side surface provided with an air outlet, wherein any one of the surfaces of the junction box is formed with an opening for mounting of the switch, and the switch is fixed directly to the opening of the junction box, wherein any one of the side surfaces of the frame is formed with an insertion opening for the junction box, and the junction box is passed through the insertion opening from inside the frame and is fixed outside of the frame, wherein a first extension part, higher than a top surface of the junction box, extends from an upper edge of an inner side surface of the junction box, and a second extension part, lower than a bottom surface of the junction box, extends from a lower edge of the inner side surface of the junction box, wherein a third extension part and a fourth extension part extend beyond both sides of the junction box from left and right side edges of the inner side surface of the junction box, respectively, and wherein a projected sheet perpendicular to the second extension part projects from the second extension part towards the junction box side, and a recess is disposed in a lower edge of the projected sheet near the second extension part.

6. The ventilating fan of claim 5, wherein: a portion of the first extension part of the inner side surface of the junction box is bent towards the junction box side to form a bent sheet.

7. The ventilating fan of claim 5, wherein: the second extension part of the inner side surface of the junction box is formed with a through hole.

* * * * *